United States Patent [19]

Ishida et al.

[11] 4,015,990

[45] Apr. 5, 1977

[54] COLOR PHOTOGRAPHIC LIGHTSENSITIVE MATERIAL

[75] Inventors: Yaichi Ishida; Hiroshi Ikeda; Shigetoshi Hiraishi, all of Nagaokakyo, Japan

[73] Assignee: Mitsubishi Paper Mills, Ltd., Tokyo, Japan

[22] Filed: June 19, 1975

[21] Appl. No.: 588,653

[30] Foreign Application Priority Data

July 9, 1974 Japan ..... 49-78421

[52] U.S. Cl. ..... 96/84 UV; 96/56; 96/100

[51] Int. Cl.[2] ..... G03C 1/84; G03C 7/00

[58] Field of Search ..... 96/56, 100, 84

[56] References Cited

UNITED STATES PATENTS

| | | | |
|---|---|---|---|
| 3,432,300 | 3/1969 | Lestina et al. | 96/56 |
| 3,574,627 | 4/1971 | Stern et al. | 96/56 |
| 3,698,909 | 10/1972 | Lestina et al. | 96/56 |
| 3,930,866 | 1/1976 | Oishi et al. | 96/56 |

*Primary Examiner*—J. Travis Brown
*Attorney, Agent, or Firm*—Cushman, Darby & Cushman

[57] ABSTRACT

A tocopherol derivative represented by the general formula, (I)

wherein R, $R_1$ and $R_2$ represent individually a hydrogen atom or a methyl group; and $R_3$ represents a straight chain or branched-chain alkyl group having 1 to 18 carbon atoms, or a substituted or unsubstituted aryl group, is incorporated as a light-fading stabilizer into the photosensitive layer of a color photographic light-sensitive material, whereby the photographic material can be prevented not only from fading and discoloration of the finally obtained color image and from discoloration of the non-color-developed portion, but also from formation of fog. Furthermore, the said stabilizer itself is excellent in dispersion stability.

8 Claims, No Drawings

COLOR PHOTOGRAPHIC LIGHTSENSITIVE MATERIAL

BACKGROUND OF THE INVENTION

This invention relates to a color photographic lightsensitive material. More particularly, the invention pertains to a color photographic lightsensitive material which is prevented from fading and discoloration of the finally obtained color image and from discoloration of the non-color-developed portion (hereinafter referred to as "texture").

Generally, color photographic lightsensitive materials are obtained by coating coupler-dispersed silver halide emulsions on a suitable support, and are ordinarily prepared in such a manner that couplers capable of forming cyan, magneta and yellow colors by coupling with the oxidation product of a color developing agent are dispersed in red-sensitive, green-sensitive and blue-sensitive silver halide emulsions, respectively, and then the coupler-dispersed silver halide emulsions are coated in a proper order on a suitable support. The thus prepared color photographic materials are exposed to light, developed with a color developing solution containing p-phenylenediamine or its derivative as a color developing agent, and then subjected to stop-fixing, bleaching, film-hardening fixing, stablization and the like treatments to form the final color images. The photographic images thus obtained are stored as records over a long period of time or are displayed. These photographic images, however, are not always stable to light, heat and moisture, so that when exposed to light for a long period of time or stored under high temperature and humidity conditions, the color images are faded or discolored and even the textures are discolored to deteriorate the images in quality, in general. Such fading and discoloration are drawbacks that can be said to be fatal for recording materials. Various processes have been proposed as procedures for overcoming these drawbacks, and the present invention is concerned with a process in which a light fading stabilizer is used to overcome the said drawbacks.

With a aim to eliminate the above-mentioned drawbacks, there have heretofore been used such compounds as, for example, hydroquinone derivatives including 2,5-di-tert-butlhydroquinone; phenol compounds such as 2,6-di-tert-butyl-p-cresole, 4,4°-methylenebis-(2,6-di-tert-butylphenol), 2,2'-methylenebis(4-ethyl-6-tert-butylphenol) and 4,4'-isopropylidenediphenol; hydroxycoumarans; and hydroxychromans. These compounds are certainly effective as agents for preventing color images from fading and discoloration, but have such disadvantages that they are low in effectiveness, degrade color tones though effective for prevention of fading, bring about formation of fog, cause insufficient dispersion, or form crystals. Thus, there have not been proposed any such compounds as to display excellent effects collectively as photographic light-fading stabilizers.

SUMMARY OF THE INVENTION

An object of the present invention is to provide a color photographic material which has been stabilized to light by incorporating into the photosensitive layer thereof a light-fading stabilizer which is free from the aforesaid disadvantages and is collectively excellent as photographic stabilizer.

As the result of extensive studies, the present inventors have found that the above-mentioned object can be accomplished by incorporating into the photosensitive layer of a color photographic lightsensitive material a tocopherol derivative represented by the general formula,

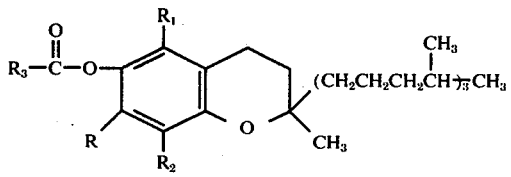

(I)

wherein R, $R_1$ and $R_2$ represent individually a hydrogen atom or a methyl group; and $R_3$ represents a straight chain or branched-chain alkyl group having 1 to 18 carbon atoms.

DESCRIPTION OF THE PREFERRED EMBODIMENT

The compounds represented by the general formula (I) which is used in the present invention include DL-, D- and L-forms. Typical examples of the said compound are as shown below, but compounds usable in the present invention are not limited to these.

Compound (1)

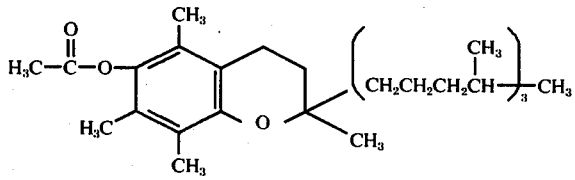

Compound (2)

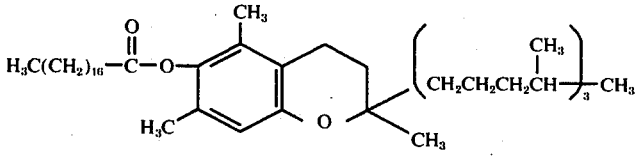

Compound (3)

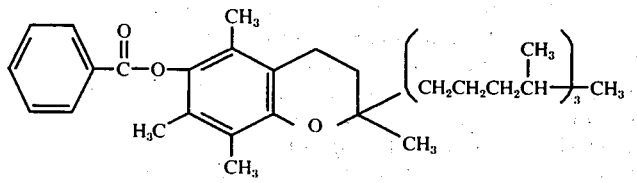

Compound (4)

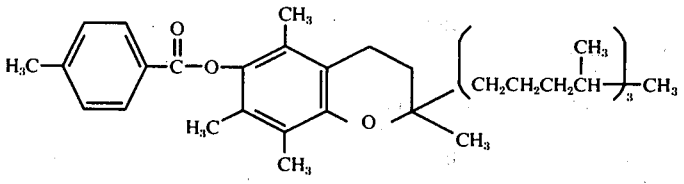

Compound (5)

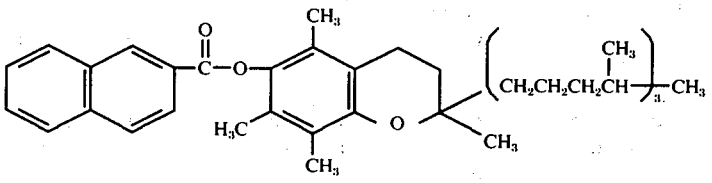

Compound (6)

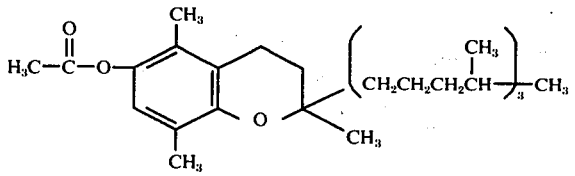

Compound (7)

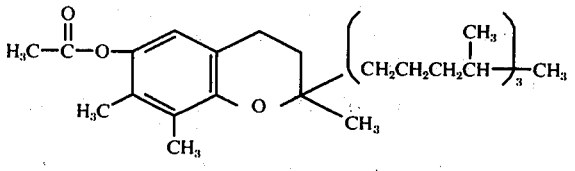

Compound (8)

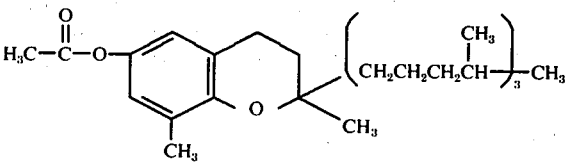

Regarding preparation of the tocopherol derivatives of the present invention, for example, said compound (1) may be prepared by the method disclosed in "Chemical Abstracts" Vol. 67, No.100001 C (page 9400). Other compounds may be produced in the similar manner.

For incorporation of the above-mentioned compound into the photosensitive layer of a color photographic material, there may be adopted such procedure that the compound is dissolved, together with couplers, in a high boiling point organic solvent such as dibutyl phthalate or tricresyl phosphate, and the resulting solution is dispersed to the form of oil droplets into an emulsion for forming the photosensitive layer. In case the compound itself is oily, it is possible to adopt such procedure that the compound is used as a solvent for couplers to form a coupler dispersion, which is then dispersed to the form of oil droplets into an emulsion for forming the photosensitive layer. Alternatively, the compound may be dispersed independently from the oil droplets of couplers, but this procedure is inferior to the above-mentioned procedures.

The dispersion to the form of oil droplets can be effected according to the process disclosed in, for example, U.S. Pat. No. 2,322,027. If necessary, a low boiling point organic solvent such as ethyl acetate may be used in combination with the aforesaid high boiling point organic solvent.

The compound of the general formula (I) which is used in the present invention is effective for preventing the fading and discoloration of magneta, yellow and cyan color images and the discoloration and coloration of the texture of a photographic material, and is particularly effective for preventing the fading of magneta color images and the yellowing of the texture.

The compound of the general formula (I) is not only higher in effect of preventing the fading of color images and the yellowing of texture due to light, particularly near-ultraviolet light, than various light-fading stabilizers which have been employed hitherto, but also is so high and practical in dispersion stability that it does not cause formation of fog even when incorporated into a silver halide emulsion, and thus is collectively excellent as a photographic light-fading stabilizer. By incorporating the said compound into the photosensitive layer of a color photographic material, the present inventors have been able to successfully accomplish the object of the present invention.

The amount of the tocopherol derivative to be used in the present invention varies depending on the kinds of couplers which are used in combination therewith, but is in the range from 5 to 200 weight % preferably from 30 to 150 weight %, based on the weight of the coupler. If the amount of the tocopherol derivative is smaller than said range, the photographic material incorporated therewith becomes extremely low in effect of preventing the fading of color image and the discoloration of texture and hence cannot be put into practical use, while if the amount thereof is excessively larger than said range, the photographic material is somewhat deteriorated in developability and the resulting color image is undesiraly lowered in color density.

The compound used in the present invention, either alone or together with couplers, is solved into a solvent and then the solution is dispersed with a surfactant into a water-soluble colloid solution. As the surfactant, there may be used any one of saponin, sodium alkylsulfosuccinates and sodium alkylbenzenesulfonates, and as the water-soluble colloid, there may be used any one of gelatin, caseine, carboxymethyl cellulose, polyvinyl alcohols, polyvinyl pyrrolidones styrene-maleic ahydride copolymers, condensation products of styrene-maleic anhydride copolymers with polyvinyl alcohols, polyacrylates and ethyl cellulose, though these are not limitative.

It is as mentioned previously that the compounds, used in the present invention are particularly effective for prevention of the fading and discoloration of magneta colors and the yellowing of textures. The couplers used in the present invention are of such a type that they are dissolved in a high boiling point organic solvent, the resulting solution is dispersed in the aforesaid water-soluble protective colloid in such a manner as mentioned previously, and the resulting dispersion is incorporated into a silver halide photographic emulsion. Typical examples of the magneta couplers used in the present invention are those disclosed in, for example, U.S. Pat. No. 2,600,788, 2,725,292, 2,908,573, 3,006,759, 3,062,653, 3,152,896 and 3,311,476, Belgian Pat. No. 681,457 and French Pat. No. 1,480,766; typical examples of the yellow couplers are those disclosed in U.S. Pat. No. 2,908,573; and typical examples of the cyan couplers are those disclosed in U.S. Pat. Nos. 2,474,293, 2,725,292, 2,895,826 and 2,908,573. Color images that are obtained by the color development of the said couplers are effectively stabilized to light by virtue of the light-fading stabilizers used in combination therewith. In case an ultraviolet absorber layer is additionally formed on a support at the time of preparation of photographic material, the effect of preventing the resulting color image from fading due to light becomes greater, though this is a matter of course. Examples of the ultraviolet absorber used in this case ae benzophenone, benzotriazole, thiazolidone, oxazole and imidazole type compounds, though these are of course not limitative.

The light-fading stabilizers employed in the present invention may be used either singly or in the form of a mixture of two or more members. Further, they may be used in combination with other fading preventors which have been used hitherto. Examples of said other fading preventors are as set forth below.

Phenol type:

2,6-Di-tert-butyl-4methylphenol 2,2'-Methylenebis(-4ethyl-6tert-butylphenol) 4,4'-Thiobis(3-methyl-6tert-butylphenol) 4,4'-Butylidenebis(3methyl-6-tert-butyl-phenol)

2,4-Dimethyl-6-tert-butylphenol 3-Methyl-2,6di-tert-butylphenol 4Isoctylphenol 2,4-Diisooctylphenol 4,4'-Methylenebis(2,6-di-tert-butylphenol)

4,4'-Isopropylidenediphenol

2-Methylphenol 2,6-Di-tert-butylphenol 2-tert-Octyl-4-dodecyloxphenol

Tetrakis(methylene-3-(3',5'-di-tert-butyl-4'-hydroxyphenyl)propionate)methane n-Octadecyl-3-(3',5'-di-tert-butyl-4'-hydroxyphenyl)propionate 6-(4'-Hydroxy-3',5'di-tert-butylanilino)-2,4bis-octadecylthio-1,3,5-triazine Monoethyl-nickle salt of 3,5di-tert-butyl-4-hydroxybenzyl phosphoric acid.

Hydroquinone type:

2,5-Di-tert-butylhydroquinone

2tert-Butyl-p-benzoquinone. 2-tert-Butyl-hydroquinone.

Chroman type:

2,2-Dimethyl-4-isopropyl-6-hydroxy-7octyl-chroman

2-Methyl-2-(4',8'-dimethyl)nonyl-5methyl-6-hydroxy-7,8-dimethoxychroma

2,2-Bis($\beta$,$\beta$-dimethylpentyl)-6hydroxy-7-tert-butyl-8methylchroman 2,2'-Bis($\beta$,$\beta$-dimethylbutyl)-6hydroxy-7tert-butylchroman $\alpha$-Tocopherol.

Coumaran type:

2-[N-Methyl-N(p-carboxymethyl)benzyl]amino-3,3-dimethyl-5 -hydroxy-6tert-octylcoumaran 6-tert-Butyl-3,3-dimethyl-2-(N'-ethoxycarbonyl-N-piperidino)-5-hydroxycoumaran 6-tert-Butyl-2ethoxyl-5hydroxy-3,3-dimethylcoumaran 2-(N-Methyl-N-phenyl)amino-3,3-dimethyl-5-hydroxy-6tert-butylbenzofuran Organic phosporus type:

Dilauryl hydrogen phosphite

Tributyl phosphite

Tris(2-ethylhexy)phosphite

Tridecyl phosphite

Triphenyl phosphite

Tetraphenyl tetratridecyl pentraerythrityl tetraphosphite

Tetraphenyl dipropylene glycol diphosphite

2-Ethylhexyl acid phosphate

Butyl acid phosphate

Amine type:

N,N'-Diphenyl-p-phenylenediamine

N,N'-Diphenylthiourea
6Ethoxy-2,2,4-trimethyl-1,2-dihydroquinoline
Thiodipropionate type:
Dilaurylthio-di-propionate
Distearylthio-di-propionate
Piperidine type:
4-Benzoyloxy-2-2,6,6-tetramethylpiperidine
4Methoxy-2,2,6,6-tetramethylpiperidine
4-Acetoxy-2,2,6,6 -tetramethylpiperidine The color photographic materials of the present invention may be processed by use of any conventional color processing agents such as, for example, color developing agents, bleaching agents and fixing agents, regardless of their kinds.

The present invention is illustrated below with reference to Examples.

EXAMPLE 1

4 Grams of magenta coupler 1-phenyl-3-(3-[α-(2,4-di-tert-amylphenoxy)butylamido)benzamido -5-pyrazolone and 4g. of the aforesaid compound (1) as a light-fading stabilizer were dissolved in a mixed solvent comprising 4 ml. of dibutyl phthalate and 15 ml. of ethyl acetate. The resulting solution was dispersed in 50 . of a 10% aqueous gelatin solution containing sodium dodecylbenzenesulfonate. The thus formed dispersion was mixed with 500 g. of a green-sensitive silver chlorobromide emulsion. Subsequently, the emulsion was incorporated with a hardener, coated on a paper support, which had been coated on both sides with polyethylene, and then dried to prepare a sample (A).

Further, samples (B), (C) and (D) were prepared in the same manner as above, except that the light-fading stabilizer was replaced by each of the compound (4), a known light-fading stabilizer DL-α-tocopherol, and 4,4'-thiobis(6tert-butyl-3-methylphenol), respectively. For comparisons, there was prepared a control sample (E) containing no light-fading stabilizer.

Each of the thus prepared samples was exposed, and then subjected at 30°C. to each of development treatment (for 4 minutes), bleach-fixing treatment (for 3 minutes), water-washing treatment (for 2 minutes) and stabilization treatment (for 1 minute), using processing solutions of the below-mentioned prescriptions.

| | |
|---|---|
| Developing solution: | |
| 2-Methyl-4-N,N-diethyl-aminoaniline | 3.0 g. |
| Sodium sulfite | 3.0 g. |
| Sodium hydroxide | 1.0 g. |
| Sodium carbonate (monohydrate) | 20.0 g. |
| Borax | 5.0 g. |
| Hydroxylamine sulfate | 2.0 g. |
| Potassium bromide | 1.0 g. |
| Benzyl alcohol | 15.0 ml. |
| Diethylene glycol | 3.0 ml. |
| Water to make | One liter |
| Bleach-fixing solution: | |
| Disodium ethylenediamine tetraacetate | 50 g. |
| Ferric chloride | 40 g. |
| Sodium carbonate (monohydrate) | 20 g. |
| Potassium bromide | 20 g. |
| Sodium thiosulfate | 200 g. |
| Water to make | One liter |

-continued

| | |
|---|---|
| Stabilizing solution: | |
| Zinc sulfate | 10 g. |
| Citric acid | 10 g. |
| Sodium citrate | 6 g. |
| Boric acid | 5 g. |
| Water to make | One liter |

Each sample, which had formed a color image in the above-mentioned manner, was subjected to fading test by exposing to direct sunlight for 10 days to obtain such results as set forth in Table 1.

Table 1

| Example | Degree of fading $\Delta D_{1.0}$ | Degree of fading $\Delta D_{2.0}$ | Discoloration of texture | Hue | Remarks |
|---|---|---|---|---|---|
| (A) | 0.32 | 0.30 | 0.11 | ○ | Compound (1) |
| (B) | 0.29 | 0.35 | 0.10 | ○ | Compound (4) |
| (C) | 0.40 | 0.70 | 0.13 | Δ | DL-α-Tocopherol |
| (D) | 0.35 | 0.65 | 0.20 | X | 4,4'-Thiobis-(6-tert-butyl 3-methyl-phenol) |
| (E) | 0.64 | 1.24 | 0.16 | ○ | For comparison |

Note 1) $\Delta D_{1.0}$: Decrease of green light density, initial density = 1.0
$\Delta D_{2.0}$: Decrease of green light density, initial density = 2.0
Note 2) Discoloration of texture: Increase of blue light density
Note 3) Hue: Change in hue of developed color Δ — More or less change observed
X — Marked change As is clear from Table 1, the samples according to the present invention were excellent in fading-preventing effect, and were favorable in hue, photographic properties, and stability of dispersion containing fading stabilizer.

EXAMPLE 2

8 Grams of a yellow coupler α-benzoyl-2-chloro-5-[γ-(2,4-di-tert-amylphenoxy)butylamido]acetanilide and 4 g. of the compound (1) as a light-fading stabilizer were dissolved in a mixed solvent comprising 15 ml. of ethyl acetate and 5 ml. of dibutyl phthalate. The resulting solution was dispersed in 50 g. of a 10% aqueous gelatin solution containing sodium dodecylbenzenesulfonate. The thus formed dispersion was mixed with 450 g. of a silver bromide emulsion. Subsequently, the emulsion was incorporated with a hardener, coated on a paper support, which had been coated on both sides with polyethylene, and then dried to prepare a sample (A).

Further, samples (B), (C) and (D) were prepared in the same manner as above, except that the light-fading stabilizer was replaced by each of the compound (4), a known light-fading stabilizer DL-α-tocopherol, and 4,4'-thisobis(6-tert-butyl-3-methylphenol), respectively. For comparison, there was prepared a sample (E) containing no light-fading stabilizer.

Each of the thus prepared samples was treated and tested in the same manner as in Example 1 to obtain such results as set forth Table 2.

Table 2

| Sample | Degree of fading $\Delta D_{1.0}$ | Degree of fading $\Delta D_{2.0}$ | Discoloration of texture | Hue | Remarks |
|---|---|---|---|---|---|
| (A) | 0.30 | 0.40 | 0.12 | O | Compound (1) |
| (B) | 0.27 | 0.43 | 0.13 | O | Compound (4) |
| (C) | 0.40 | 0.62 | 0.18 | Δ | DL-α-Tocopherol |
| (D) | 0.35 | 0.55 | 0.30 | X | 4,4'-Thiobis-(6-tert-butyl-3-methylphenol) |
| (E) | 0.60 | 1.05 | 0.25 | O | For comparison |

As is clear from Table 2, the samples according to the present invention were excellent in fading-preventing effect, and were favorable in hue, photographic properties, and stability of dispersion containing fading stabilizer.

EXAMPLE 3

3.2 Grams of a cyan coupler N-n-octyl-l-hydroxy-2-napthamide and 3 g. of the compound (1) as a light-fading stabilizer were dissolved in a mixed solvent comprising 5 ml. of dibutyl phthalate and 15 ml. of ethyl acetate. The resulting solution was dispersed in 50 g. of a 10% aqueous gelatin solution containing sodium dodecylbenzenesulfonate. The thus formed dispersion was mixed with 500 g. of a red-sensitive silver chlorobromide emulsion. Subsequently, the emulsion was incorporated with a hardener, coated on a paper support, which had been coated on both sides with polyethylene, and then dried to prepare a sample (A).

Further, samples (B), (C) and (D) were prepared in the same manner as above, except that the light-fading stabilizer was replaced by each of the compound (4), a known light-fading stabilizer DL-α-tocopherol, and 4,4'-thiobis(6-tert-butyl-3methylphenol), respectively. For comparison, there was prepared a sample (E) containing no light-fading stabilizer.

Each of the thus prepared samples was treated and tested in the same manner as in Example 1 to obtain such results as set forth in Table 3 .

Table 3

| Sample | Degree of fading $\Delta D_{1.0}$ | Degree of fading $\Delta D_{2.0}$ | Discoloration of texture | Hue | Remarks |
|---|---|---|---|---|---|
| (A) | 0.11 | 0.32 | 0.02 | O | Compound (1) |
| (B) | 0.10 | 0.34 | 0.02 | O | Compound (4) |
| (C) | 0.19 | 0.42 | 0.04 | Δ | DL-α-Tocopherol |
| (D) | 0.25 | 0.45 | 0.15 | X | 4,4'-Thiobis-(6-tert-butyl-3-methylphenol) |
| (E) | 0.30 | 0.67 | 0.04 | O | For comparison |

As is clear from Table 3, the samples according to the present invention were excellent in fading preventing effect, and were favorable in hue, photographic properties and stability of dispension containing fading stabilizer.

What is claimed is:

1. In a color photographic lightsensitive material comprising a support and, coated thereon, a coupler-dispersed silver halide emulsion, the improvement in that the said emulsion contains as a light-fading stabilizer at least one tocopherol derivative having the general formula,

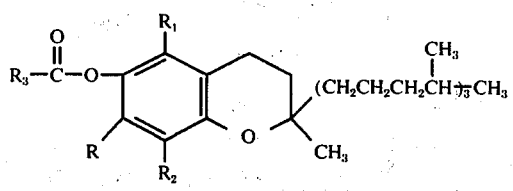

(I)

wherein R, $R_1$ and $R_2$ represent individually a hydrogen atom or a methyl group; and $R_3$ represents a straight chain or branched-chain alkyl group having 1 to 18 carbon atoms, or a methyl substituted or unsubstituted aryl group.

2. A color photographic lightsensitive material as claimed in claim 1, wherein the amount of the said tocopherol derivative is 5 to 200 weight %, based on the weight of the coupler.

3. A color photographic lightsensitive material as claimed in claim 1, which additionally contains an ultraviolet absorber.

4. A color photographic lightsensitive material as claimed in claim 1, which additionally contains other fading-preventing agent.

5. A color photographic lightsensitive material as claimed in claim 1, wherein the light-fading stabilizer is selected from the following group:

Compound (1)
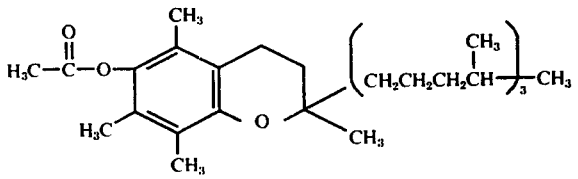
Compound (2)
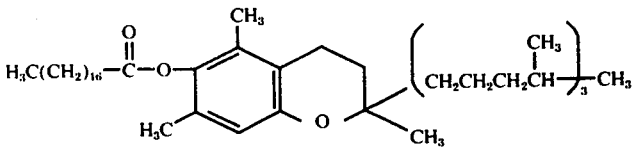
Compound (3)
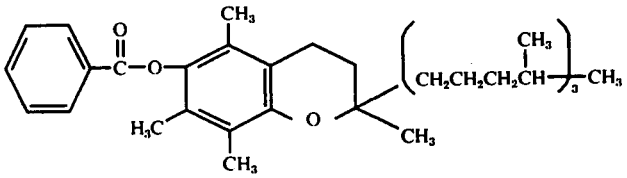
Compound (4)
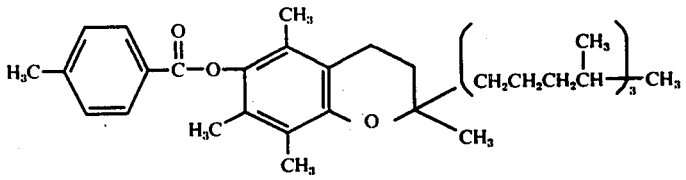
Compound (5)
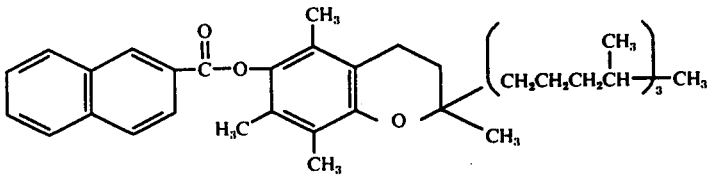
Compound (6)
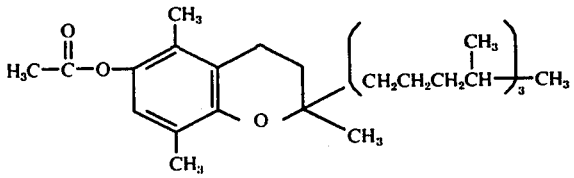
Compound (7)
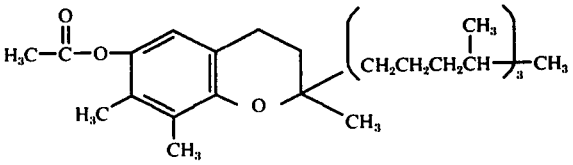
Compound (8)
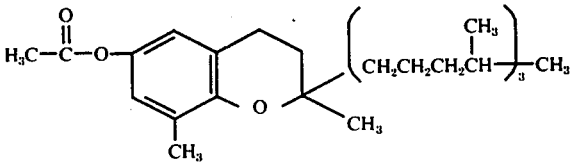

6. A color photographic lightsensitive material as claimed in claim 1 wherein the amount of said tocopherol derivative is 30 to 150 weight %.

7. A color photographic lightsensitive material as claimed in claim 1 which additional contains a benzophenone, benzotriazole, thiazolidone, oxazole or imidazole type ultraviolet absorber.

8. A color photographic lightsensitive material as claimed in claim 1 which additionally contains another fading-preventing agent from the group consisting of the phenol type, the hydroquinone type, the chroman type, the coumaran type, the organic phosphorus type, the amine type, the thiodipropionate type and the piperidine type of fading-preventing agent.

* * * * *